US010456825B2

(12) United States Patent
Vannod et al.

(10) Patent No.: US 10,456,825 B2
(45) Date of Patent: Oct. 29, 2019

(54) METHOD FOR PRESS-ROLLING A TIMEPIECE MAINSPRING

(71) Applicant: Nivarox-FAR S.A., Le Locle (CH)

(72) Inventors: Jonas Vannod, Auvernier (CH); Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 220 days.

(21) Appl. No.: 15/615,263

(22) Filed: Jun. 6, 2017

(65) Prior Publication Data

US 2017/0355012 A1 Dec. 14, 2017

(30) Foreign Application Priority Data

Jun. 10, 2016 (EP) ..... 16173898

(51) Int. Cl.

| | |
|---|---|
| ***B21F 3/08*** | (2006.01) |
| ***G04D 3/00*** | (2006.01) |
| ***G04B 1/14*** | (2006.01) |
| ***G04B 17/06*** | (2006.01) |
| *B21D 5/14* | (2006.01) |

(Continued)

(52) U.S. Cl.

CPC ..... *B21F 3/08* (2013.01); *G04B 1/145* (2013.01); *G04B 17/066* (2013.01); *G04D 3/0007* (2013.01); *G04D 3/0041* (2013.01); *B21D 5/14* (2013.01); *B21F 3/00* (2013.01); *B21F 35/02* (2013.01); *Y10T 29/49579* (2015.01)

(58) Field of Classification Search

CPC ... B21F 3/08; B21F 35/02; B21F 3/00; G04D 3/0007; G04D 3/00; G04D 3/0041; G04B 1/145; G04B 17/066; B21D 5/14; Y10T 29/49579–49586

USPC ..... 72/170–173; 29/896.3–896.34

See application file for complete search history.

(56) References Cited

U.S. PATENT DOCUMENTS

| | | | |
|---|---|---|---|
| 2,131,147 | A | 9/1938 | Siegenthaler |
| 2,316,462 | A | 4/1943 | Siegenthaler |

(Continued)

FOREIGN PATENT DOCUMENTS

| | | | |
|---|---|---|---|
| CH | 187668 | | 11/1936 |
| CH | 708 674 | A2 | 4/2015 |
| WO | WO 2008/102388 | A1 | 8/2008 |

OTHER PUBLICATIONS

English Machine Translation of CH 708674 A2, Zappella, published Apr. 15, 2015.*

(Continued)

*Primary Examiner* — Sarang Afzali

(74) *Attorney, Agent, or Firm* — Oblon, McClelland, Maier & Neustadt, L.L.P.

(57) ABSTRACT

Method for press-rolling a mainspring, from a wire comprising a pre-formed eye, utilizing a roller press comprising a first support and guide means exerting a force on the wire in a first contact area located between a second and a third contact area comprised in a second and a third support and guide means, in order to wind, beyond the eye, an accumulation area with an opposite curvature to that of the eye, and wherein, as the wire advances, the position of the first contact area is gradually moved away from the second and third contact areas, to vary the press-rolling radius from a first minimum value to a second maximum value at a neck junction between the accumulation area and the eye.

11 Claims, 2 Drawing Sheets

(51) Int. Cl.
*B21F 3/00* (2006.01)
*B21F 35/02* (2006.01)

(56) References Cited

U.S. PATENT DOCUMENTS 6,185,969 B1 * 2/2001 Jaubert ..... B21D 7/021
72/172
2010/0089114 A1 4/2010 Boldrini

OTHER PUBLICATIONS

European Search Report dated Nov. 16, 2016 in European Application 16173898.4, filed on Jun. 10, 2016 (with English Translation of Categories of cited documents & Written Opinion).

* cited by examiner

METHOD FOR PRESS-ROLLING A TIMEPIECE MAINSPRING

This application claims priority from EP No. 16173898.4 filed on Jun. 10, 2016, the entire disclosure of which is hereby incorporated herein by reference.

FIELD OF THE INVENTION

The invention concerns a method for press-rolling the spiral part of a timepiece mainspring, from a wire that is pre-drawn and rolled, said wire comprising in succession, from the start of the strip, an eye formed prior to said press-rolling, with a curvature whose centre is on an outer side of said wire, said eye being followed by a neck comprising an area of zero curvature and forming an area of bending, and said neck being followed by an accumulation area which, during said press-rolling operation, is intended to be press-rolled into a spiral with a curvature whose centre is on an inner side of said wire, opposite to said outer side, said accumulation area ending with a strip end.

The invention concerns the field of timepiece mainsprings and their manufacture.

BACKGROUND OF THE INVENTION

The manufacture of timepiece mainsprings is complex, and requires numerous steps, including a step of forming a ring and/or a step of press-rolling a portion of a wire, at one end of which an eye has previously been formed, to form the strip of the spring.

This press-rolling operation is complex, and requires perfect reproducibility. The spring is awkward to handle following the press-rolling operation.

CH Patent Application No 708674A2 in the name of Générale Ressort discloses an equipment for shaping a metal wire during a mainspring manufacturing method, comprising a system for driving the wire in two directions opposite to each other, and comprising a device for guiding and ejecting the wire; the equipment also includes a press-rolling device located in a first direction with reference to the drive system, an eye producing device located in the second, opposite direction, and a central wire-guide arranged on the drive system and intended to cooperate with at least one of the press-rolling and eye producing devices to deform the metal wire.

WO Patent Application No 2008/102388A1 in the name of Boldrini Spa discloses a roller press comprising a support structure carrying two rollers and a pressure roller which, in cooperation with each other, define a curved feed path for a plate to be bent. The rollers are movable relative to the pressure roller to vary at least one curvature value of the feed path. The apparatus further includes a pair of articulated kinematic mechanisms, each of which acts on a respective roller to move it along a plurality of paths located in a transverse plane to the axis of rotation of the roller.

SUMMARY OF THE INVENTION

The object of the press-rolling is to guarantee the operation of the spring. In fact, the entire strip of the spring must provide the maximum torque as the mainspring is let down. That is to say that, at every location on the strip, the spring surface is stressed to its elastic limit in the completely wound state.

The invention proposes to modify the press-rolling process to avoid a conventional, expensive operation of shaping the spring into a ring at the end of manufacture, for example to perform a treatment; and, more particularly, to produce an intermediate product that can be stored and handled flat.

The invention must make it possible to avoid the unnecessary use of processing installations with voluminous tools, and facilitate the handling of springs, while eliminating the usual operation of removal of the ring after the treatment.

The press-rolling process consists in forcing the strip spring between two rollers and a motorized shaft to create a three-point bending of the strip, making plastic deformation thereof possible.

Rolling is usually performed with a constant diameter, which entails a stack of coils, which cannot resume their flat shape once they leave the plane of the coils. This problem is all the more significant if the spring diameter is small.

The invention proposes the implementation of a gradual or variable press-rolling technique, which makes it possible to produce a press-rolled spring with a constant or variable space, depending on adjustments, between the coils. The object is to facilitate handling in subsequent operations of the manufacturing process, and to eliminate the usual tangle of wires in a jumble. The invention makes it possible to guarantee smaller diameter press-rolling on the press-rolled portion that corresponds to the start of the process, and to increase the diameter moving closer to the eye.

The principle of the invention also consists in forcing the strip between three points to exceed the elastic limit locally in the strip and thus to form the press-rolled portion.

To this end, the invention concerns a method for press-rolling a mainspring according to claim 1.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
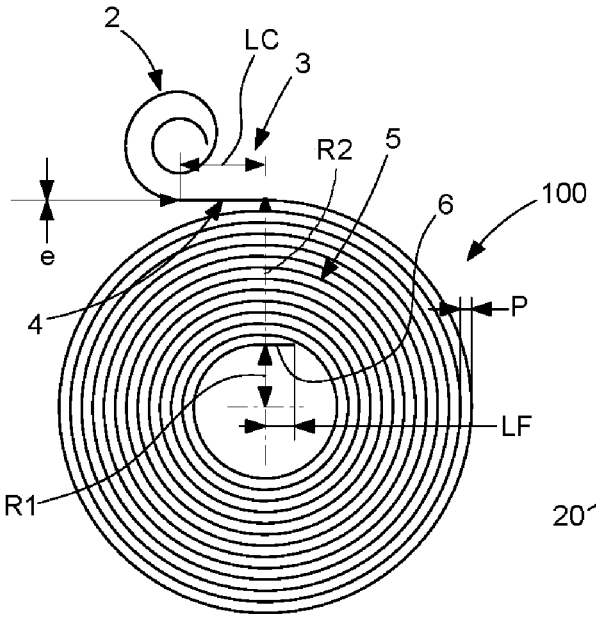
FIG. 1 shows a schematic, plan view of a timepiece mainspring press-rolled according to the method of the invention.

The invention concerns a method for press-rolling the spiral portion of a timepiece mainspring 100, from a pre-drawn and rolled wire 1.

This wire 1, of thickness "e", includes in succession, from the start of the strip, an eye 2 formed prior to press-rolling, with a curvature whose centre is on an outer side of wire 1.

A first operation 1000 thus consists of the preparation of a drawn and rolled wire 1, with the completely formed eye 2. In particular, this eye includes, where appropriate, a usual opening arranged to cooperate with a hook of a barrel arbor. The preparation of this wire and eye is standard for those skilled in the art, specialized in the manufacture of mainsprings, and is not described in detail here.

This eye 2 is followed by a neck 3 of length LC, including an area of zero curvature 4 and forming an area of bending.

This neck 3 is followed by an accumulation area 5, which is the only area affected by the second operation 2000 according to the invention, which is a press-rolling operation. During the press-rolling operation, this accumulation area 5 is intended to be press-rolled into a spiral with a curvature whose centre is on an inner side of wire 1, opposite to the outer side.

Accumulation area 5 ends in a strip end 6, and may advantageously, but not necessarily, comprise a short, non-spiral, end length LF, which forms the first part where the press-rolling operation starts.

According to the invention, the operation is a variable press-rolling operation, and more particularly a gradual press-rolling operation.

According to the invention, there is implemented a roller press 20 which includes at least a first support and guide means 10 arranged to exert a force F on wire 1 in a first intermediate contact area A, which is located between a second B and a third C end contact area respectively comprised in a second 12 and third 13 support and guide means, comprised in roller press 20, to wind accumulation area 5 in an opposite curvature to that of eye 2.

And, as wire 1 advances inside roller press 20, the position of first contact area A is gradually modified away from second contact area B and third contact area C, to vary the press-rolling radius from a first minimum value R1 to a second maximum value R2 at the junction between accumulation area 5 and neck 3, where the press-rolling operation ceases.

Figure 3:
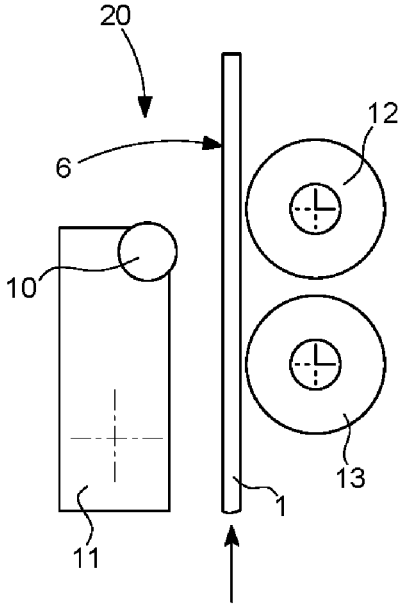
FIG. 3 shows, in a similar manner to FIG. 2, the wire placed in contact with three support and guide means on either side of the wire.
Figure 4:
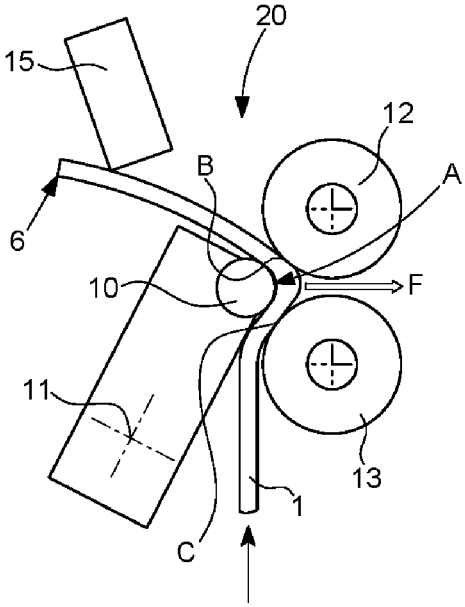
FIG. 4 shows, in a similar manner to FIG. 3, the intermediate support and guide means pressing on the wire.
Figure 5:
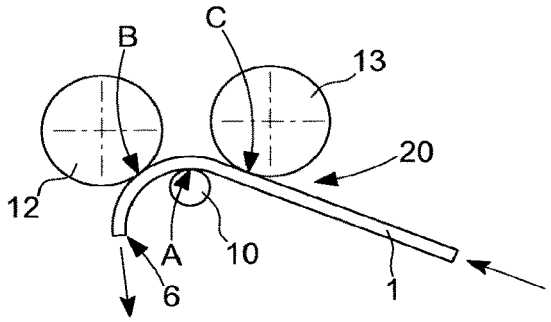
FIG. 5 shows, in a similar manner to FIG. 4, another angle of insertion of the wire into the roller press.
Figure 6:
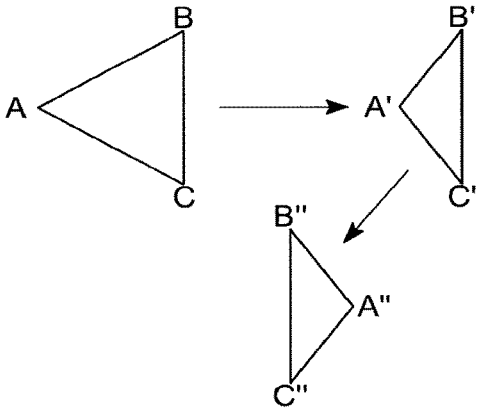
FIG. 6 shows a schematic view of the deformation of the triangle of contact between the three support and guide means and the wire, as the intermediate support and guide means advances with respect to the two ends.
Figure 7:
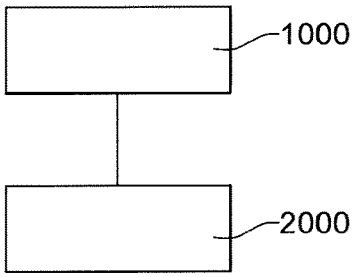
FIG. 7 is a block diagram of the main operations of the method according to the invention.

FIG. 3 illustrates wire 1 placed in contact with the three support and guide means 10, 12, 13, arranged on either side of wire 1, at the start of the press-rolling operation. FIG. 4 illustrates intermediate support and guide means 10 pressing on wire 1. FIG. 6 shows the deformation of the triangle of contact ABC between the three support and guide means 10, 12, 13, and wire 1, as intermediate support and guide means 10 advances with respect to the two ends 12 and 13.

In a particular implementation of the invention, the third support and guide means 13 is held in a fixed position.

In a particular implementation of the invention, the second support and guide means 12 is held in a fixed position.

In a particular implementation of the invention, the first support and guide means 10 is moved with respect to the second and third support and guide means 12, 13 which are fixed.

In a particular implementation of the invention, the first support and guide means 10 and/or the second support and guide means 12 are moved with respect to the third support and guide means 13, which is in a fixed position.

In a particular implementation of the invention, a slide 11, carrying first support and guide means 10, is moved with at least one degree of freedom, to exert a force F on wire 1.

More particularly, a regular advance movement is imparted to slide 11, making possible the gradual press-rolling of the invention.

FIGS. 3 and 4 illustrate a particular, non-limiting embodiment where this slide 11 pivots, which represents a particular deformability of the triangle ABC of supports.

In a particular implementation of the invention, a deflector 15 is placed on the path of wire 1 once it leaves the press-rolling area to ensure the correct winding thereof.

First support and guide means 10, second support and guide means 12 and third support and guide means 13, may each be made in the form of a fixed arbor, a free roller, or a motorized roller to ensure the advance of wire 1 inside roller press 20.

If more than one are motorized, they may be not perfectly synchronous, so as to ensure, for example, a tension of wire 1, in the press-rolling area between second contact area B and third contact area C. In a variant, second support and guide means 12 and third support and guide means 13 are both motorized, and the first tends to impart to the wire a slightly higher tangential speed than the second.

The optional addition of a die stamping operation makes it possible to eliminate the flat press-rolling portion present at the end of the strip, from the start of press-rolling operation to the ring-shaping for the heat treatment. This may avoid bending usual springs with added bridles.

The invention is illustrated in a particular, non-limiting case where first support and guide means 10 is a shaft, and second support and guide means 12 and third support and guide means 13 are two rollers. In short, at a given moment, the contact surfaces between shaft 10, the two rollers 12, 13 and wire 1 determine on the latter a profile close to an arc of a circle with a certain instantaneous curvature.

For spring 1000 to be able to be wound flat on the work bench, this instantaneous curvature must vary more or less regularly throughout the press-rolling of spiral accumulation area 5.

This instantaneous curvature increases, if possible in a regular manner, from the end of the strip to the neck.

Figure 2:
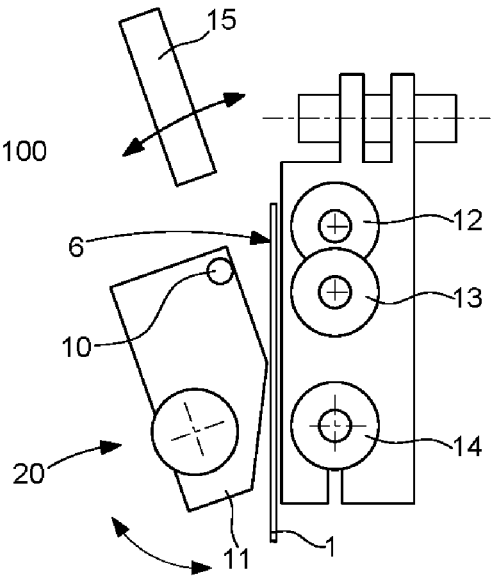
FIG. 2 shows a schematic top view of a roller press for implementing the method according to the invention with a wire inserted for press-rolling.

For example, there is applied to slide 11, which carries shaft 10, a pressure that increases regularly with the advance of wire 1, defined by the rotational speed of at least one motorized roller, which may be roller 14 of FIG. 2, or roller 12 and/or roller 13, this rotational speed also being adjustable.

To quantify the press-rolling diameters, let us cite a few examples of different sizes;

inner or initial diameter 2R1: 3-15 mm
external or final diameter 2R2: 12-40 mm
Coil pitch P: 0-10 strip thickness
strip length: 100-1000 mm To implement this method, there is used a roller press 20, which includes the different devices described above.

This roller press 20 includes, on either side of a press-rolling area arranged to receive a wire 1, pre-fitted with an eye 2 at one end, on a first side at least a first support and guide means 10 arranged to exert a force F on such a wire 1 in a first intermediate contact area A, which is located between a second end contact area B and third end contact area C respectively comprised in a second 12 and third 13 support and guide means, comprised in roller press 20 on a second side, opposite to the first side with respect to the press-rolling area. The exertion of force F on wire 1 creates thereon an accumulation area 5 with an opposite curvature to that of eye 2.

More particularly, first support and guide means 10 is movable with respect to second 12 and third 13 support and guide means.

More particularly, roller press 20 includes means for moving the first support and guide means 10 to create a variable force F.

More particularly, these means of movement are arranged to impart on a movable slide 11, carrying the at least one first support and guide means 10, an advance movement, or a regular advance movement, to achieve gradual press-rolling. More particularly, the means of movement are arranged to impart to a movable slide 11 at least one pivoting motion.

More particularly, roller press 20 includes a deflector 15, placed on the path of wire 1 once it leaves the press-rolling area, to ensure the correct winding thereof. Naturally, this deflector 15 may be motorized, and movable with one or more degrees of freedom.

More particularly still, the first support and guide means 10 and/or the second support and guide means 12 and/or the third support and guide means 13 is made in the form of a motorized roller to ensure the advance of wire 1 inside the press-rolling area. More particularly, at least two of these first support and guide means 10, second support and guide means 12, and third support and guide means 13 are motorized in a non-synchronous manner, to ensure a tension of wire 1 inside the press-rolling area.

More particularly, roller press 20 includes at least one motorized drive roller 14 for ensuring the advance of wire 1 inside the press-rolling area.

The various motorized means are naturally arranged to allow the advance of wire 1 to leave roller press 20 after the press-rolling operation.

Naturally, roller press 20 may advantageously comprise drive means and/or storage means, for driving the various motorized members and for reproducing the stored sequences in an identical manner in order to obtain springs in a reproducible manner. These drive means may also be combined with sensors measuring the thickness of the spring downstream of the press-rolling area, and/or measuring its concavity after press-rolling.

The invention makes it possible to manufacture a timepiece mainspring 100, whose coils are not joined, and are remote from each other in the free state of the spring. More particularly, this spring 100 is a Teflon coated spring, whose Teflon coated coils are remote from each other in the free state of the spring. The invention makes it possible to produce such a spring.

The gradual press-rolling technique according to the invention provides several advantages:

the wire follows a one-way path;

the elimination or at least the reduction in tangling of the springs during handling, and during batch operations, such time in the furnace, cleaning, Teflon coating, loading onto automatic machines, owing to the separation of the coils of the springs, since the press-rolling method according to the invention is studied so that each spring remains in a flat configuration and does not unwind during handling;

reduction in scratches due to friction with the rollers and shafts of the roller press;

elimination of contact between the coils, resulting in more efficient cleaning, particularly using solvents, and Teflon coating;

reduction in the tangling of the spring resulting from the interlacing of coils, which was frequent in the prior art.

The invention claimed is:

1. A method for press-rolling a mainspring, from a wire having an eye with a first curvature pre-formed in a first operation, comprising:

using a roller press comprising a first support and guide means to exert a force on said wire in a first contact area of the wire, the first contact area being located between a second and a third contact area of said wire with a second and a third support and guide means, respectively, in a second operation to wind, beyond said eye, an accumulation area with a second curvature opposite to the first curvature of said eye, said first contact area being on a first side of the wire and the second and third contact areas being on a second side of the wire opposite to said first side, and advancing the wire and, during the advance of said wire, gradually moving the position of said first contact area in a direction toward said second and third contact areas, to vary a press-rolling diameter from a first minimum value to a second maximum value at a neck junction between said accumulation area and said eye;

wherein said first contact area is located between the second and third contact areas in a longitudinal direction of said wire.

2. The method according to claim 1, wherein said roller press includes, on either side of a press-rolling area arranged for receiving said wire, on a first side at least one said first support and guide means, and on a second side, opposite to the first side with respect to the press-rolling area, said second and third support and guide means, and wherein said roller press comprises means for moving said first support and guide means to create a variable force, said means of movement are arranged to impart to a movable slide, carrying said at least one first support and guide means, an advance movement, or a regular advance movement, to achieve gradual press-rolling, with at least one degree of freedom of said slide, to exert said force on said wire.

3. The method according to claim 2, wherein at least one of said first, second and third support and guide means comprises a motorized roller to ensure the advance of said wire inside said press-rolling area, and at least two of said first, second and third support and guide means, which are motorized in a non-synchronous manner with respect to the motorized roller, the method comprising:

advancing the wire using the motorized roller, and applying tension to the wire using the at least two of said first, second and third support and guide means.

4. The method according to claim 3, wherein said roller press is used, with at least one of drive means and a storage means, for driving the various motorized members and reproducing stored sequences in an identical manner to obtain springs in a reproducible manner, said drive means being combined with sensors measuring the thickness of said spring downstream of said press-rolling area, and/or sensors measuring the concavity of said spring after press-rolling.

5. The method according to claim 1, wherein at least one of said second and third support and guide means is held in a fixed position.

6. The method according to claim 5, comprising moving said first support and guide means with respect to said second and third support and guide means, which are fixed.

7. The method according to claim 1, comprising placing a deflector on a path of said wire once said wire leaves the press-rolling area to ensure the correct winding thereof.

8. The method according to claim 7, wherein said deflector, which is movable with at least one degree of freedom, is motorized.

9. The method according to claim 1, comprising stopping said second operation when said second maximum value is reached.

10. The method according to claim 1, comprising moving at least one of said first support and guide means and said second guide and support means with respect to said third support and guide means, which is in a fixed position.

11. The method according to claim 1, wherein gradually moving the position of the first contact area comprises moving said first support and guide means in a direction from said first side towards said second side.

* * * * *